United States Patent [19]

Taylor

[11] Patent Number: 4,619,098

[45] Date of Patent: Oct. 28, 1986

[54] METALLIC STRUCTURAL MEMBER PARTICULARLY FOR SUPPORT OF WALLS AND FLOORS OF BUILDINGS

[76] Inventor: Lawrence H. Taylor, P.O. Box 49-58, 48th Street Station, Union City, N.J. 07087

[21] Appl. No.: 662,505

[22] Filed: Oct. 19, 1984

[51] Int. Cl.[4] ..... E04C 3/32; E04B 1/88

[52] U.S. Cl. ..... 52/738; 52/481; 52/673; 52/720; 52/731

[58] Field of Search ..... 52/720, 731, 738, 673, 52/481

[56] References Cited

U.S. PATENT DOCUMENTS

| | | | |
|---|---|---|---|
| 2,098,752 | 11/1937 | Miller | 52/731 |
| 2,924,856 | 2/1960 | Price | 52/483 X |
| 2,968,070 | 1/1961 | Wolstead | 52/362 X |
| 3,129,792 | 4/1964 | Gwynne | 52/364 |
| 3,270,472 | 9/1966 | Gilbert | 52/364 |
| 3,282,005 | 11/1966 | Birdwell | 52/364 |
| 3,956,998 | 5/1976 | Bavetz | 52/481 |
| 4,016,700 | 4/1977 | Blomstedt | 52/481 X |
| 4,075,810 | 2/1978 | Zakrzewski | 52/585 |
| 4,506,481 | 3/1985 | Witschi et al. | 52/364 |
| 4,513,551 | 4/1985 | Gauffin et al. | 52/364 |

FOREIGN PATENT DOCUMENTS

| | | | |
|---|---|---|---|
| 611658 | 10/1960 | Italy | 52/720 |
| 1056897 | 2/1967 | United Kingdom . | |

*Primary Examiner*—Alfred C. Perham

*Attorney, Agent, or Firm*—Kerkam, Stowell, Kondracki & Clarke

[57] ABSTRACT

A structural metallic member particularly useful for framing interior and exterior walls, ceilings and floors of building structures consists of a hollow generally quadrangular in transverse cross-section stud consisting of at least three contiguous walls with the middle of the at least three walls being provided with a multiplicity of parallel, spaced, longitudinal rows of longitudinally spaced slits with alternate rows of slits being staggered such that the longitudinal spaces of one row are positioned substantially midway of the length of the slits of adjacent rows. In a form of studs where there are four contiguous walls, the slits are provided in the pair of opposed walls that will connect the inside and outside walls of the structure.

4 Claims, 5 Drawing Figures

METALLIC STRUCTURAL MEMBER PARTICULARLY FOR SUPPORT OF WALLS AND FLOORS OF BUILDINGS

BACKGROUND OF THE INVENTION

Steel structural members or studs in the form of c-beams and box 2×4's have been used for a number of years in construction work as framing for interior walls and for exterior walls which support, for example, plaster board and exterior sheathing. Such steel studs when used as structural members for exterior walls have a primary drawback in that they readily conduct exterior heat into the air-conditioned building in the summer and do the reverse in winter when the heat loss in cold weather can be so serious that the walls are discolored, called "shadowing", as moisture, including greasy dirt, is deposited on the colder parts of the wall in direct contact with the steel beams supporting the wall.

How serious is this heat loss, or gain, may be seen by considering that a small house of approximately 900 square feet and having dimensions of about 32′×28′ provided with studs 24″ on center would have approximately 60 beams or studs about its perimeter. If each stud has dimensions of a 2″×4″, with the 2″ sides facing outside and inside there would be a total of steel exposed to the exterior siding equivalent to an area 8′ high by 10′ wide surface. This is a very considerable area (over 8%) radiating cold from the exterior wall through the interior wall into the house or, in summer, radiating heat into the house.

BRIEF SUMMARY OF THE INVENTION

It is a primary object of the present invention to provide metallic structural members or studs which are provided with a plurality of rows of longitudinally spaced slits in the side walls forming the major dimension of the studs perpendicular to the line of the house walls with alternate rows of slots being staggered in such a manner that the solid longitudinal spaces of one row are positioned substantially midway of the length of the slots of adjacent rows thereby materially narrowing and at the same time lengthening the flow path of heat or cold from one end face (exterior and interior) to the other end face throughout the length of the beam. The reduced heat, cold or sound transmission of such a structural member or stud provides for a materially improved stud without substantially reducing the structural strength of such stud or materially increasing its cost.

The invention may be generally defined as a structural metallic member particularly useful for framing, interior and exterior walls, floors and ceilings (joists) of building structures consisting of a hollow, generally quadrangular, in transverse cross section, stud or joist having at least three contiguous walls with the middle of the at least three walls being provided with a multiplicity of parallel, spaced, longitudinal rows of longitudinally spaced slits with alternate rows of slits being staggered such that the longitudinal spaces of one row are positioned substantially midway of the length of the slots of adjacent rows, to thereby reduce the area through which heat, cold or sound can be transmitted and increasing the length that heat or cold must be transmitted between the two non-slitted walls of the stud or joist, and decrease the area for sound transmission.

BRIEF DESCRIPTION OF THE DRAWINGS

The invention will be more particularly described with reference to the accompanying drawing wherein:

FIG. 3 is a fragmentary, perspective view of a box type beam formed from a panel such as shown in FIGS. 2 and 2*a.

Figure 1:
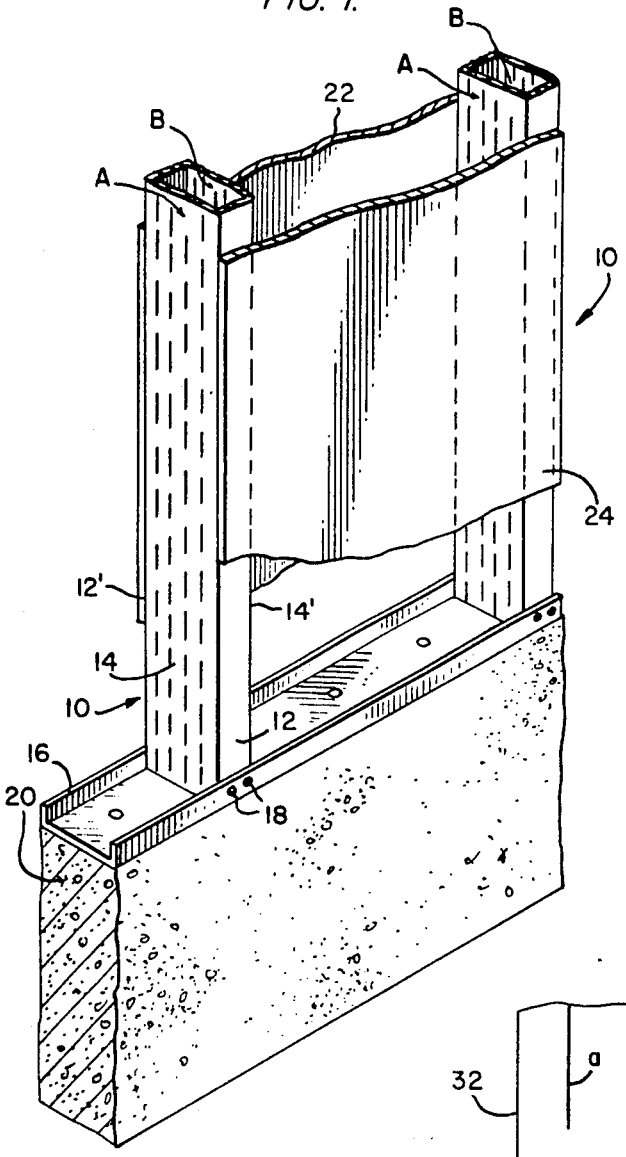
FIG. 1 is a fragmentary, perspective view of box type studs constructed in accordance with the present invention supporting inside wall board and exterior sheathing.

Referring to the drawings and, in particular to FIGS. 1–3, 10 generally designates a hollow, metallic stud which by way of example has ends 12 and 12′ having widths of about 2″ and side walls 14 and 14′ having widths of about 4″. It will be recognized that the invention is equally suited to beams or studs having other dimensions such as 2×6's, 2×8's, etc.

The studs are illustrated in FIG. 1 mounted in a steel runner or plate 16 by metal screws 18 with the runner or plate 16 attached to a foundation wall 20 of a building.

The studs 10 support outside wall means 22 which may comprise the usual wall means in building construction. The studs 10 also support interiorally an inner wall 24 which may comprise conventional gypsum or composite wallboard.

Figure 2:
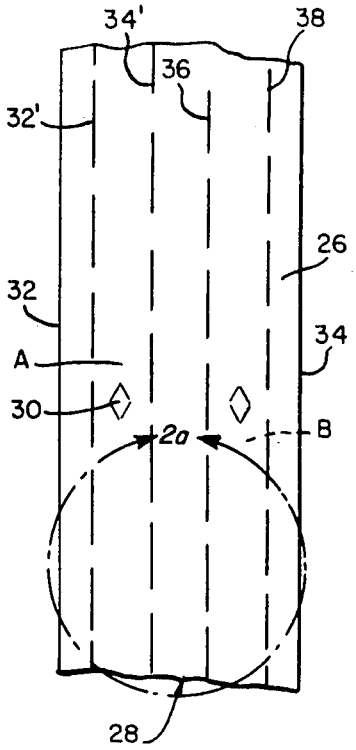
FIG. 2 is a plan view of a sheet of, for example, steel perforated or slitted in accordance with the teachings of the invention and ready to be folded into a box type stud.
Figure 2A:
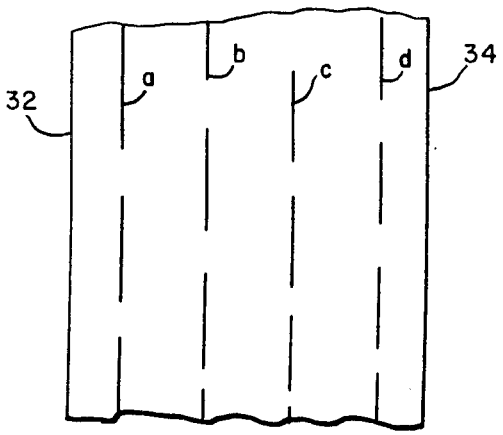
FIG. 2*a* is an enlarged view of the area in the circle in FIG. 2 to more accurately show the positioning of the slits in the side wall of a stud.

With particular reference to FIGS. 2 and 2*a,* the stud 10 is formed from a sheet of, for example, 22 gauge steel 26 which is provided with two zones designated A and B with a plurality of rows of slots generally designated 28. In FIGS. 2 and 2*a,* fold lines are designated 32′, 34′, 36′ and 38′. The sheet 26 may also be provided with "punchouts" such as at 30 for wiring and pipes, as the case may be. Referring particularly to FIG. 2*a,* the rows of slots are lettered a, b, c and d. The slits a and c are transversley aligned and the slits b and d are also coextensive in length and parallel to each other.

It will be particularly noted that alternate rows a and b, b and c, c and d are staggered such that the longitudinal solid spaces h between slits in any row are positioned substantially midway of the length of the slots of adjacent rows. Thus, it will be seen that the path of heat transfer is materially lengthened and interrupted in order to limit transmition of heat or cold from one edge 32 to an opposite edge 34, because the heat must take a circuitous and longer path and be transmitted through marrow bands of solid metal thereby reducing effective heat transfer transversely of the stud.

In an example, the slits are approximately 1½″ in length and the slits are spaced from each other in any one row ½″ with the spacing between adjacent rows of slits about ½′ to 1″. These dimensions have proven to be very satisfactory but are not considered to be particularly critical. Also, in this same example, the slits have a width of about a very thin knife space such as, for example, 15 thousandths of an inch.

In particularly hot or cold areas to further reduce heat or cold transfer the length of metal zones h between slits would be reduced to say $\frac{1}{4}$ or $\frac{1}{8}$ inch. In such case, in order to insure the stud has sufficient strength, the stud would be made of heavier gauge steel, for example 20 gauge. However, the increase in the cost of the heavier gauge steel would be recovered in heating and cooling power requirements for the structure containing the improved studs.

Figure 3:
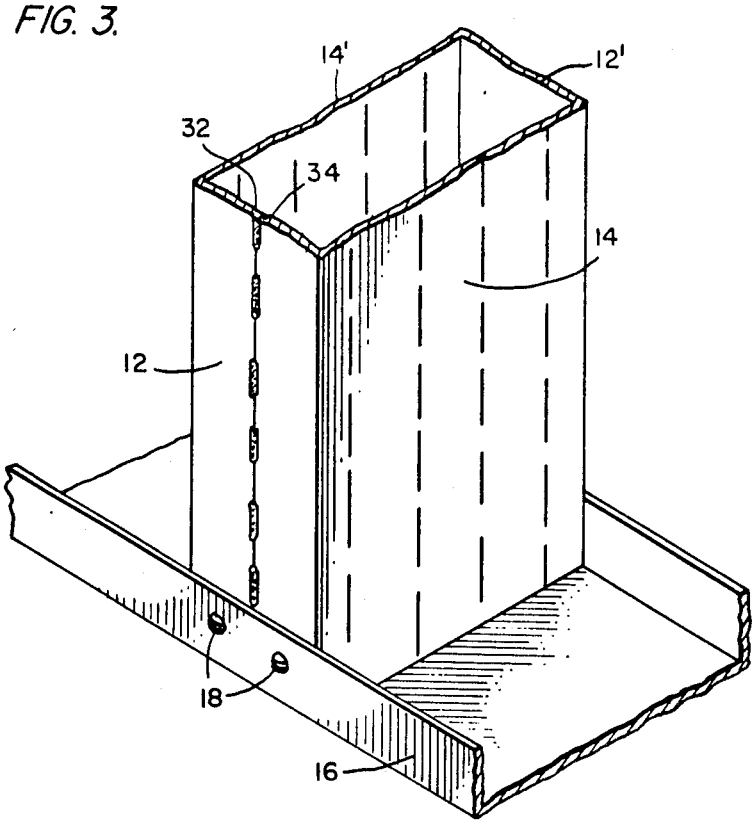

To complete the manufacture of the improved structural metallic member, the sheet 26 is bent along bend lines indicated at 32', 34', 36 and 38 into a box configuration as shown, for example, in FIG. 3 and edges 32 and 34 are welded or otherwise fastened into a stud or joist configuration.

Figure 4:
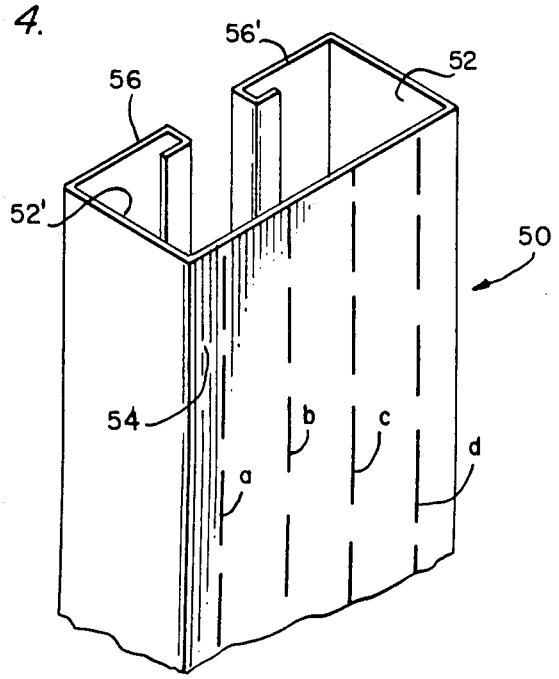
* and FIG. 4 is a fragmentary, perspective view of a c-beam constructed in accordance with the teachings of the present invention.

Referring now to FIG. 4, there is shown a c-shaped stud in transverse cross section designated 50 formed of 20 gauge plus or minus 8 gauge steel though heavier and lighter gauges may be used and having end walls 52 and 52', side wall 54, and two noncontiguous or nonjoining side walls 56 and 56'. While this beam provides better insulating qualities as the walls 56 and 56' do not readily transmit cold or heat, the beam does lack some of the obvious structural advantages of a hollow, quadrangular beam of the other box form of the invention. In this form of the invention, wall 54 is provided with the heat restricting slots a-d as in the other form of the invention, with the slots being spacially and relatively arranged in the same manner.

Having described my invention, what is claimed is:

1. A structural metallic member particularly useful for forming interior and exterior wall, floor and ceiling support means of building structures consisting of a hollow, generally quandrangular in transverse cross-section stud consisting of at least three contiguous walls with the middle of the at least three walls being provided with a multiplicity of parallel, spaced, longitudinal rows of longitudinally spaced slits, said slits having a width of about 15,000ths of an inch to thereby reduce transmission of heat and sound there across and to prevent convection of air currents therethrough, alternate rows of slits being staggered such that the longitudinal spaces of one row are positioned substantially midway of the length of the slits of adjacent rows thereby further reducing sound and heat transmission across said at least three walls.

2. The invention defined in claim 1, wherein the stud is configured as a c-beam.

3. A structural metallic member particularly useful for framing interior and exterior walls, floors and ceilings of building structures consisting of a hollow, generally quandrangular in transverse cross-section stud consisting of four contiguous sides, one opposed pair of walls of the stud are provided with a multiplicity of parallel, spaced, longitudinal rows of longitudinally spaced slits, said slits having a width of about 15,000ths of an inch to thereby reduce transmission of heat and sound there across and to prevent convection of air currents therethrough, alternate rows of slits being staggered such that the longitudinal spaces of one row are positioned substantially midway of the length of the slits of adjacent rows thereby further reducing sound heat transmission across said opposed pair of walls.

4. The invention defined in claim 3, wherein the stud is configured as a box beam.

* * * * *